United States Patent [19]

Robinson

[11] 4,300,365

[45] Nov. 17, 1981

[54] KNITTING METHOD

[75] Inventor: Frank Robinson, Breaston, England

[73] Assignee: Courtaulds Limited, London, England

[21] Appl. No.: 91,896

[22] Filed: Nov. 7, 1979

[30] Foreign Application Priority Data

Nov. 20, 1978 [GB] United Kingdom ..... 45318/78

[51] Int. Cl.[3] ..... A41B 9/06

[52] U.S. Cl. ..... 66/176

[58] Field of Search ..... 66/175, 176

[56] References Cited

U.S. PATENT DOCUMENTS 3,057,178 10/1962 Konklin ..... 66/176

3,882,697 5/1975 Betts et al. ..... 66/176

FOREIGN PATENT DOCUMENTS 1494335 7/1967 France ..... 66/176

*Primary Examiner*—Ronald Feldbaum

*Attorney, Agent, or Firm*—Davis, Hoxie, Faithfull & Hapgood

[57] ABSTRACT

A method of knitting a blank for a sleeved garment wherein the blank is knitted in one piece in the form of a cross starting at the waist of a body panel, subsequently knitting fabric constituting a sleeve and shoulder region of the blank and finally knitting a further body panel in the direction from the neck region to the waist. In knitting the portion of the first body panel above the arm pit level, progressively shorter courses are formed and in knitting the portion of the further body panel above the arm pit level, progressively longer courses are formed, whereby the outer parts of the sleeve and shoulder fabric are inclined with respect to the courses in the body panels.

1 Claim, 4 Drawing Figures

KNITTING METHOD

Figure 1:
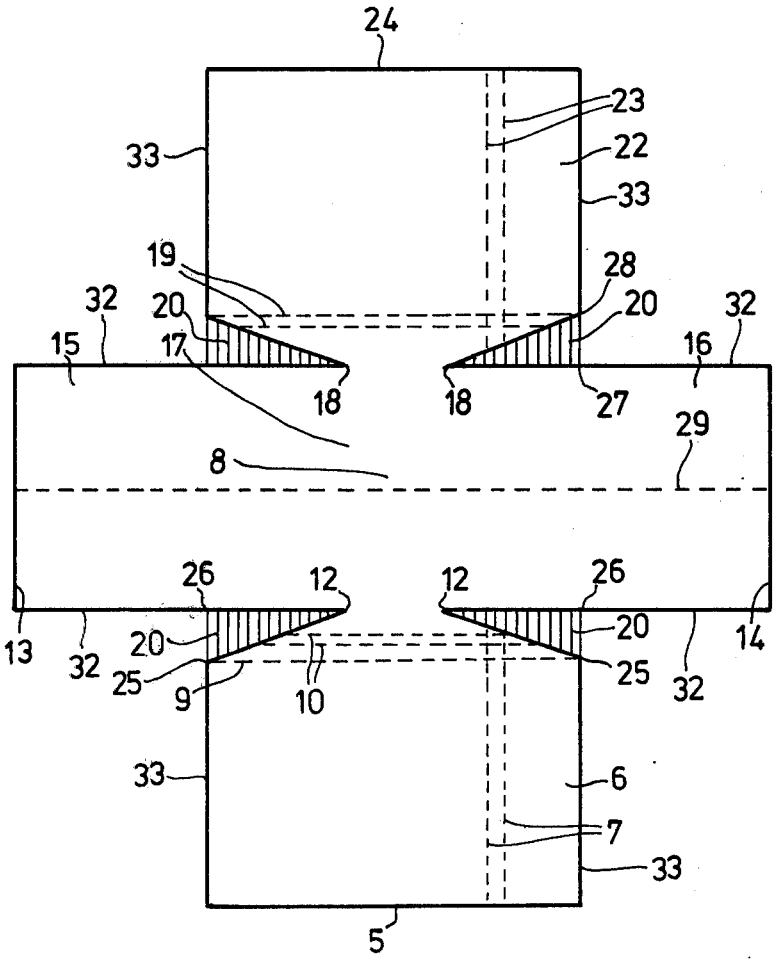

This invention relates to the manufacture of sleeved garments.

There has previously been proposed a method of knitting a blank for a sleeved garment in which knitting is begun at the waist of a front or rear body panel and is carried on up to the arm pit level, the knitting field of active needles is then widened to encompass the length of both sleeves from cuff to cuff and an intervening shoulder region which is knitted in direct continuation of the body panel, and finally knitting is concluded by completing whichever body panel (rear or front) was not knitted previously, in direct continuation of the shoulder region. The blank is folded along a centre line of the sleeve fabric extending from cuff to cuff through the shoulder region and the sleeves are seamed along the under-arm lines and the body panels up the sides. A neck opening is cut out and finished to complete the garment.

The knitting method just described produces a garment in which the sleeves extend out from the body at right angles and such garments may not always fulfil the dictates of fashion. The present invention is concerned with a development of this method in which the sleeves in the finished garment are inclined downwardly with respect to the horizontal in the garment as worn. This is achieved, according to the present invention by knitting a blank for a sleeved garment by a method comprising the steps of starting knitting along a waist section of the garment blank and knitting a body panel having wales extending towards the neck region of the garment blank, continuing knitting of the body panel up to the arm pit level, thereafter continuing the knitting of the body panel, using courses which become shorter towards the neck region of the garment blank, until the body panel is completed, knitting a unitary piece of sleeve and shoulder fabric for the garment blank having courses extending from cuff to cuff of the garment blank and having in a central shoulder region wales which are extensions of wales of said body panel, commencing the knitting of a further body panel having wales extending away from the neck region of the garment blank which are extensions of wales of the central shoulder region of the sleeve and shoulder fabric, and knitting increasingly longer courses in the further body panel as knitting progresses away from the neck region of the garment blank to the arm pit level, whereby the outer parts of the courses in the sleeve and shoulder fabric are inclined with respect to the courses in the body panels, and completing knitting of the further body panel from the arm pit level to the waist.

In the method of the invention, the procedure adopted in knitting the courses of different length brings about a true inclination of the courses of the sleeve fabric in relation to the courses of the body fabric. Previous proposals for knitting courses of different length in the region of the overarm line of the sleeve have only given the appearance of a downward sleeve inclination without producing a true inclination of the sleeve courses.

Figure 2:
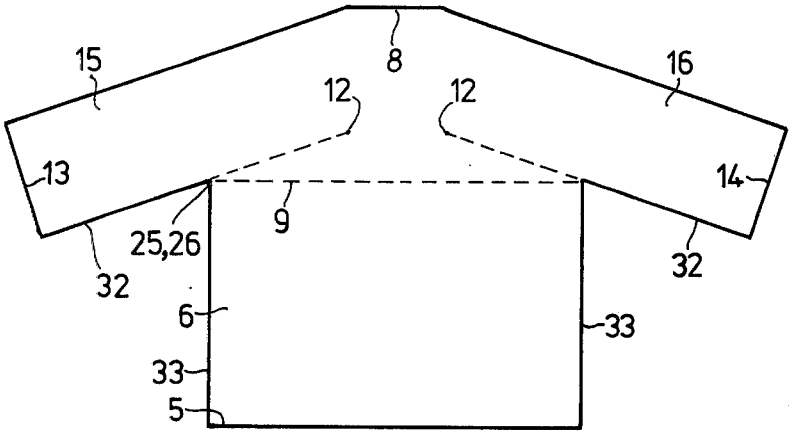
Figure 3:
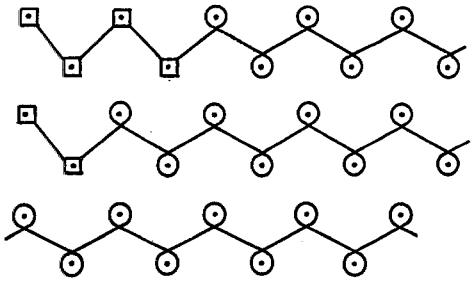
Figure 4:
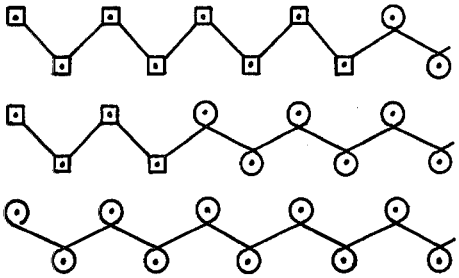

The invention will be further described, by way of example, with reference to the accompanying drawings in which:

FIG. 1 illustrates a garment blank produced by the method according to the invention, FIG. 2 illustrates a completed garment according to the invention, and FIGS. 3 and 4 are stitch diagrams illustrating two alternative procedures at one stage in the method described with reference to FIGS. 1 and 2.

In knitting the blank shown in FIG. 1, knitting is begun at the waist 5 and a body panel 6 (front or rear) is formed with wales 7 which extend from the waist in the direction of the neck region 8 of the garment. On completion of the body panel 6 up to the arm pit level 9 in the garment, knitting of the body panel is continued using courses 10 which become progressively shorter towards the neck region 8. These progressively shorter courses are formed by taking needles progressively out of action from both arm pits inwardly towards the centre line of the garment. The needles taken out of action are operated in such a way as to retain their last-knitted loops in their hooks.

Because of the progressive shortening of the courses 10 above the arm pit level 9 the wales 7 at the right-and left-hand sides of the body panel 6 in FIG. 1 are shorter than the wales formed towards the centre of the body panel. When the region of progressively decreasing courses has been completed, the still active needles extend between points 12 in the neck region of the garment. At this stage, needles extending from cuff 13 to cuff 14 of the garment are brought into action to knit fabric constituting the two sleeves 15 and 16 and the intervening shoulder region 17 of the garment with courses extending from cuff to cuff. All the needles made inactive during formation of the progressively shortening courses are thus brought back into action en bloc.

On completion of the rectangular piece of fabric constituting the sleeves 15 and 16 and the shoulder region 17, knitting of a further body panel 22 is commenced on a shortened course 18—18 equal to the length of the course 12—12 and then with courses 19 which become longer in the direction away from the neck region 8 of the garment until an active knitting field is reached equal in width to the maximum width of the body panel 6. Knitting of the body panel 22 is then completed with wales 23 extending away from the neck region 8 of the garment to the waist 24.

The wales 23 are extensions of wales in the central shoulder region 17 of the sleeve fabric and those wales are extensions of the wales 7 of the body panel 6. Thus wales extend continuously through the garment blank from waist to waist and courses extend continuously from cuff to cuff.

The shortening of the wales towards the right and left of the body panels 6 and 22 in FIG. 1 is indicated by the full lines 20. The lines 20 are intended to indicate that the fabric at opposite ends of the lines is in fact joined at one point. Thus the lines 12—25 and 12—26 are in fact the same line in the fabric, as are the lines 18—27 and 18—28. Therefore, when the blank is folded along the overarm line 29 extending from cuff to cuff through the shoulder region 17, the sleeves 15 and 16 assume a downward inclination with respect to the body of the garment as shown in FIG. 2, this downward inclination being dictated by the inclination of the outer parts of the courses of the sleeve and shoulder fabric to the courses in the body panels and this inclination being produced by the formation of the courses of different length near the neck region of the garment.

The garment is completed by seaming along the under arm lines 32 and up the sides 33 and cutting out and finishing a neck opening. Instead of a steady progressive decrease and increase in course length before and after knitting the sleeve and shoulder fabric, courses of different length may be used which show overall an increase or decrease in length but display a configuration in which, when increasing the course length, at least some courses are nevertheless shorter than the previous course and, when decreasing the course length, at least some courses are nevertheless longer than the previous course. The overall rate of increase or decrease in course length determines the angle of inclination of the sleeves in the finished garment.

Two possible procedures for carrying out the knitting of the body panel 6 above the level 9 are illustrated in FIGS. 3 and 4. Each of these Figures shows diagrammatically parts of three successive courses of stitches on the needles of one needle bed of a knitting machine employed to carry out the present method. The courses are located in the region just above the arm pit level 9 and only the left-hand end of each course is shown. A circular loop indicates a loop which is held on a needle still actively engaged in the knitting process. A square loop indicates a loop held on a needle which has been taken out of action.

In FIG. 3 it can be seen that, after the completion of each course, two needles are taken out of action at each end of the active knitting width (the procedure at the opposite end of the knitting, which is not visible, being identical to that of the end illustrated). This rate of removal of needles from action produces a steep angle of inclination of the sleeve in relation to the body. In FIG. 4, four needles are shown as removed from knitting action after each course. This rate of needle removal produces a shallow angle of inclination of the sleeve to the body.

When increasing the number of active needles during the initial stage of knitting the body panel 22, needles are similarly brought into action at a rate dependent on the angle of inclination required for the sleeve.

The length of the final course 12—12 of the shortened courses is chosen in relation to the overall effect desired. When a steep angle of inclination is chosen for the sleeves, corresponding to a slow overall rate of taking needles out of action, the course 12—12 will, in general, be longer than when a shallow angle of sleeve inclination is chosen with a corresponding rapid rate of taking needles out of action.

What is claimed is:

1. A method of knitting a blank for a sleeved garment, said method comprising the following steps:

(1) starting knitting along a waist section of the garment blank and knitting a body panel having wales extending towards the neck region of the garment blank, (2) continuing knitting said body panel up to the arm pit level, (3) thereafter continuing knitting said body panel, using courses which become shorter towards the neck region of the garment blank, until said body panel is completed, (4) knitting a unitary piece of sleeve and shoulder fabric for the garment blank having courses extending from cuff to cuff of the garment blank and having in a central shoulder region wales which are extensions of wales of said body panel, (5) commencing knitting a further body panel having wales extending away from the neck region of the garment blank which are extensions of wales of said central shoulder region of the sleeve and shoulder fabric, (6) knitting increasingly longer courses in said further body panel as knitting progresses away from the neck region of the garment blank to the arm pit level, whereby (7) the outer parts of the courses in the sleeve and shoulder fabric are inclined with respect to the courses in the body panels, and (8) completing knitting of said further body panel from the arm pit level to the waist.

* * * * *